United States Patent [19]

Lloyd

[11] Patent Number: 4,865,755

[45] Date of Patent: Sep. 12, 1989

[54] METHOD FOR INCORPORATING POWDERED DETERGENT INGREDIENTS INTO A MELTBLOWN LAUNDRY DETERGENT SHEET

[75] Inventor: William D. Lloyd, Neenah, Wis.

[73] Assignee: Kimberly-Clark Corporation, Neenah, Wis.

[21] Appl. No.: 189,888

[22] Filed: May 3, 1988

[51] Int. Cl.[4] ..... C11D 3/37; C11D 11/00; C11D 17/04

[52] U.S. Cl. ..... 252/91; 156/62.2; 156/167; 252/174; 427/242; 428/236; 428/245; 428/289

[58] Field of Search ..... 252/90, 91, 174; 428/236, 245, 260, 279, 289; 156/62.2, 167; 427/242

[56] References Cited

U.S. PATENT DOCUMENTS

| | | | |
|---|---|---|---|
| 4,100,324 | 7/1978 | Anderson | 428/288 |
| 4,248,928 | 2/1981 | Spadini | 428/286 |
| 4,511,495 | 4/1985 | Melville | 252/522 A |

*Primary Examiner*—Prince E. Willis
*Assistant Examiner*—Kathleen Markowski
*Attorney, Agent, or Firm*—Gregory E. Croft

[57] ABSTRACT

A method for making a meltblown liquid laundry detergent sheet provides increased detergent solids by incorporating powdered liquid detergent ingredients into the meltblown web during the formation of the meltblown web. Thereafter the balance of the liquid detergent formulation is incorporated into the web by saturating the web with a solution containing the balance of the liquid detergent ingredients and drying.

4 Claims, 2 Drawing Sheets

METHOD FOR INCORPORATING POWDERED DETERGENT INGREDIENTS INTO A MELTBLOWN LAUNDRY DETERGENT SHEET

BACKGROUND OF THE INVENTION

Laundry detergents are most commonly available in either liquid or powder form. In order to use such detergents, the user must measure out a certain quantity from a supply bottle or box and pour the measured amount into the clothes washer. In addition, if a fabric softener is desired, the fabric softener must be separately measured or at least separately deposited into the washer or dryer. Such multiple products, containers, and measuring can be messy and, at the very least an inconvenience, particularly for apartment dwellers who must carry all the necessary containers, etc., to the laundry area.

In this regard, the prior art discloses a variety of alternative cleaning products which are intended to provide improved convenience to the consumer. For example, U.S. Pat. No. 4,356,099 to Davies et al. discloses a laundry cleaning product comprising a plastic bag containing a liquid detergent. The bag has a weak seal which is opened by the mechanical action of the washing machine, thereby releasing the liquid detergent.

U.S. Pat. No. 4,188,304 to Clarke et al. discloses a similar detergent product comprising a plastic bag containing a particulate detergent. The bag contains a water-sensitive seal which discharges the contents of the bag when contacted with water.

U.S. Pat. No. 3,686,075 to Morton discloses a sheet substrate containing a fabric softener which is to be preferably used in the clothes dryer, but can also be added to a wash machine during its rinse cycle.

U.S. Pat. No. 4,170,565 to Flesher et al. discloses a laundry product comprising a detergent composition contained between two layers of a water-insoluble permeable substrate such as a polypropylene meltblown web. When contacted by water during the wash cycle, the detergent is dissolved and permeates through the substrate into the wash water. Most significantly, at column 1, lines 56–65, Flesher et al. apparently recognize the potential value of a single layer substrate for delivering laundry detergent, but concluded it is not feasible because of difficulty in loading the substrate with a sufficient amount of detergent and the sticky feel of any product that might be produced.

Therefore there is a need for a laundry cleaning product containing a sufficient premeasured amount of detergent which is convenient to use and economical to manufacture.

SUMMARY OF THE INVENTION

It has been discovered that meltblown webs possess a unique ability to absorb and hold an amount of liquid detergent sufficient to wash a load of laundry. However, it has also been found that in preparing liquid detergent formulations to be incorporated into the meltblown web, the presence of certain detergent enhancing ingredients, such as sodium citrate, which is used as a water softening agent, creates an unstable solution and minimizes the total amount of active detergent solids (surfactant) that can be added to the detergent formulation. In turn, this limits the total amount of active detergent solids that can be incorporated into a meltblown detergent sheet. To overcome this difficulty, it has been discovered that the total amount of active detergent solids incorporated into the meltblown sheet can be increased if the sodium citrate and/or other detergent enhancers in the liquid detergent formulation are substantially independently incorporated into the meltblown web prior to the balance of the formulation. In this way the creation of an unstable solution is avoided and the amount of active detergent solids that can be incorporated into the meltblown web is increased by up to 25 percent. As used herein, the term "detergent enhancers" refers to detergent formulation ingredients which promote phase separation of the liquid detergent formulation and includes anti-redeposition agents, water softening agents, and salts. Conveniently, most detergent enhancers, such as sodium citrate, salts of ethylenediaminetetraacetic acid (EDTA), and carboxymethyl cellulose, are available in the form of powders.

Hence, in one aspect, the invention resides in a meltblown web comprising from about 0.01 to about 1 gram of powdered liquid detergent ingredients per gram of untreated base web interspersed among the meltblown fibers. The powdered ingredients can be physically entrapped among the meltblown fibers and/or they can be adhered thereto. For purposes herein, both conditions shall be referred to as being adhered thereto. This product can be produced and sold as a special basesheet material for the manufacture of laundry detergent sheets.

In another aspect, the invention resides in a method for making a laundry detergent sheet comprising: (a) forming a meltblown web by meltblowing a thermoplastic polymer to form fibers which are deposited onto a travelling forming wire; (b) interspersing powdered liquid detergent ingredients among the meltblown fibers before the meltblown fibers are completely solidified; (c) solidifying the meltblown fibers, whereby the powdered liquid detergent ingredients become adhered thereto; (d) saturating the web with a solution comprising active detergent solids; and (e) drying the web to a water content of about 10 percent or less. For purposes herein, the term "saturating" is used to mean substantially incorporating the detergent into the web, including partial saturation and total saturation. The term "solidify" as used herein means that the fibers have hardened to a point where they are no longer sufficiently tacky to stick to each other. It is within the scope of this invention to add the powdered ingredients directly into the stream of meltblown fibers between the die tip and the forming wire or by adding the powdered ingredients on top of the newly-formed web onto which another layer of meltblown fibers is deposited, as in the case of multi-bank meltblowing processes. In some instances, the powdered liquid detergent ingredients can retain their integrity notwithstanding the saturation step, in which case the final product will contain discernible particles of the powdered liquid detergent ingredients in addition to the condensed active detergent solids, which have a gel-like or waxy consistency.

The meltblown web can be any meltblown web made from a thermoplastic polymer having a melting point greater than 110° C. Polymers which melt at lower temperatures ar likely to melt if exposed to clothes dryer temperatures. A suitable polymer is polypropylene, which is the most commonly used polymer for making meltblown webs. However, polymers having melting points of about 165° C. or greater and preferably above 200° C. or greater are preferred. Preferred polymers include poly(butylene terephthalate), which melts at about 221° C., polycaprolactam (nylon which melts at about 220° C., poly(ethylene terephthalate), which melts at about 250° C., and polymethyl pentene, which melts at about 240° C.

The process for making such meltblown webs is well known in the art and is used extensively for manufacturing a wide variety of commercial nonwoven products. Representative examples of the meltblowing process are described in U.S. Pat. No. 3,978,185 to Buntin et al. dated Aug. 31, 1976; U.S. Pat. No. 4,298,649 to Meitner dated Nov. 3, 1981; and U.S. Pat. No. 4,100,324 to Anderson et al. dated July 11, 1978, all herein incorporated by reference. For purposes of meltblowing, it is preferred that the apparent viscosity of the polymer as it leaves the die tip be about 500 poise or less, most preferably from about 150 to about 300 poise. Higher apparent viscosities provide lower throughputs which are generally unsatisfactory for commercial operation. Increased throughputs can be achieved by lowering the apparent viscosity, which can be lowered either by lowering the molecular weight of the polymer or by raising the temperature of the polymer. It will be appreciated, however, that other meltblowing processes will produce webs suitable for purposes of this invention. The meltblown web can be combined or laminated to other supporting webs, such as spunbonded webs, in order to impart strength or other attributes to the product.

The basis weight for a single sheet of the untreated meltblown base webs of this invention can range from about 80 to about 300 grams per square meter. Preferably the basis weight will be from about 110 to about 250, and most preferably about 160 grams per square meter. Basis weights lower than the abovesaid range lack sufficient pore volume to hold the amount of liquid detergent necessary to wash a load of laundry at a reasonable sheet size. Basis weights greater than the abovesaid range are too difficult to convert. It is within the scope of this invention, however, to incorporate more than one ply into the product to increase the detergent load.

The size of the meltblown web can be from about 200 to about 2000 square centimeters, preferably from about 600 to about 1,000 square centimeters, and most preferably about 800 square centimeters. The minimum size of the web is limited by the amount of liquid detergent the web can absorb and hold. The maximum size is determined by consumer acceptance, convenience and packaging considerations. It is preferred that the meltblown web be pattern bonded to maintain integrity during use. Pattern bonding is commonly performed during convert of meltblown webs by hot embossing or ultrasonic bonding of the newly formed web. The product of this invention can be dispensed in sheet form or from perforated rolls. In addition, the single sheets can be perforated to be torn in half for half loads of laundry.

The liquid detergent formulations useful for making products in accordance with this invention can be any liquid detergent which is suitable for cleaning laundry. As is well known in the detergent arts, these formulations typically contain a large number of components such as surfactants, solubilizers, fragrances, brighteners, dyes, and builders such as pH adjusters, anti-redeposition compounds, and water softening agents.

The powdered ingredients used in these formulations which can be incorporated into the meltblown web in accordance with this invention primarily include the detergent enhancers, but can also include pH control agents, enzymes, brighteners, fragrances, etc. Specific ingredients include sodium citrate, carboxymethyl cellulose, EDTA salts, sodium carbonate, sodium silicate, phosphates, alumino silicates, nitrilotriacetic acid salts, sodium borate, poly(vinyl alcohol), poly(vinyl acetate), and polyvinyl pyrrolidone. The amount of each powdered ingredient will vary widely depending upon the specific detergent formulation. However, in general, the powdered ingredients can be present in the following amounts (grams per sheet): water softeners (0–20); anti-redeposition agents (0–5); pH control agents (0–10); enzymes (0–5); and brighteners (0–3).

The balance of the detergent ingredients which can be incorporated into the meltblown web after the powdered ingredients have been added primarily include the active detergent solids, but other ingredients can also be added at this point, such as stabilizers, pH control agents, brighteners, enzymes, dyes, etc. The active detergent solids include surfactants such as nonionic, anionic, amphoteric, and cationic surfactants and are introduced into the web as a liquid. The final cleaning product will contain an amount of liquid laundry detergent sufficient to wash a load of laundry. The amount of active detergent solids will be at least 1 gram per gram of web, preferably from about 2 to about 5 grams per gram of web, and most preferably from about 3 to about 4 grams per gram of web.

DETAILED DESCRIPTION OF THE DRAWING

Figure 1:
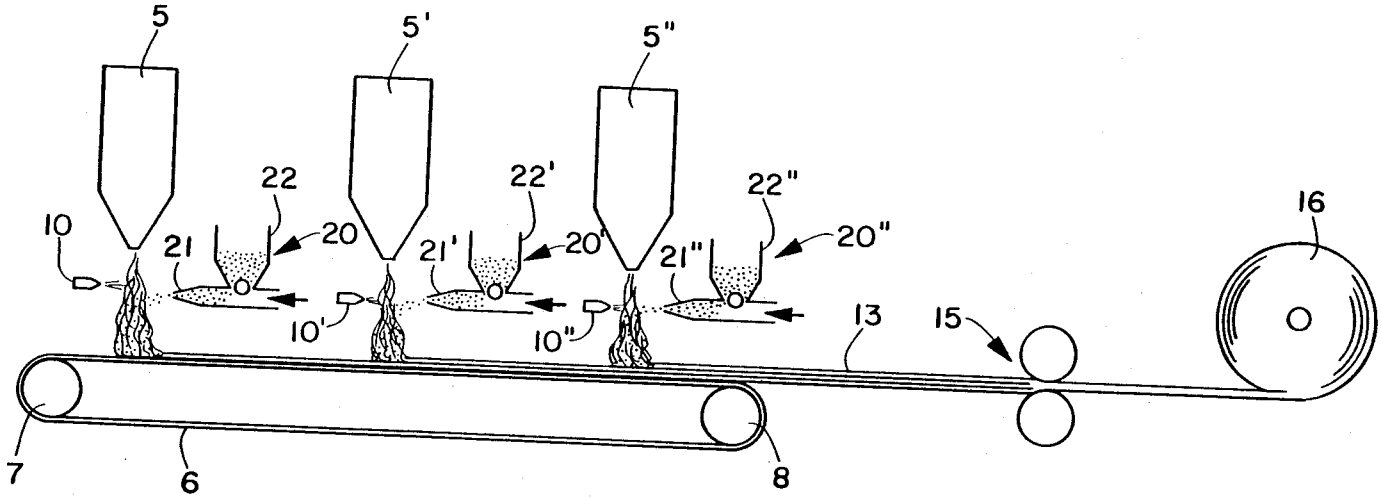
FIG. 1 is a schematic view of a meltblowing process for incorporating the powdered liquid detergent ingredients into the meltblown web in accordance with this invention.

Directing attention to FIG. 1, the invention will be described in greater detail. Shown is a process for making meltblown webs utilizing a plurality of meltblowing banks 5, 5', and 5''. These banks include an extruder and a meltblowing die tip or head which substantially extends across the width of the forming fabric 6, which travels in a continuous loop around rolls 7 and 8, at least one of which is suitably driven. Each of the banks is supplied with molten polymer from an extruder and a source of compressed air. The extrudate is broken up by the compressed air to form discontinuous molten fibers which are deposited onto the forming wire. Shown in FIG. 1 for purposes of illustration are three banks in series, but for purposes of this invention any number can be used depending upon the throughput from each bank, desired production speeds, and the basis weight of the meltblown web product. Each bank can be accompanied by an optional aqueous quench shower 10 as shown which serves to accelerate the solidification of the molten polymer fibers as they are laid upon the forming wire to form a nonwoven fibrous network. After formation, the resulting meltblown web 13 is preferably passed through a hot embossing roll nip 15 to thermally bond the web and enhance its integrity. The web is then wound up on a suitable roll 16 for further processing or converting.

The powdered detergent ingredients are incorporated into the meltblown web via a spray device 20, which comprises a source of compressed air, a nozzle 21, and a suitable powder metering device 22. The powder metering device continually drops the proper amount of powder into the air stream which is directed at the downwardly flowing meltblown fiber stream before it reaches the forming wire. A suitable commercially available spray device of this type is sold by OXY-DRY Sprayer Corporation. However, other devices capable of spraying powders are also suitable.

The concentration or deposition rate of each ingredient will vary with the specific detergent formulation, the particular ingredient, the line speed, the basis weight of the meltblown web, the air flow rate, the tackiness of the fibers, etc.

It is preferred that the powdered detergent ingredients be incorporated into the meltblown web via powder spray devices accompanying only the intermediate or central banks and not via the first and/or last bank(s). The reason for this preference is that some of the powdered detergent ingredients may cause stickiness, which is better confined to the central portion of the meltblown web rather than being present on the surface(s). Therefore, referring to FIG. 1, the preferred powdered detergent ingredient-location would be via powder spray device 20'. However, for purposes of this invention, all or some of the banks can be accompanied by one or more powder spray devices. In some instances, it may be useful to apply the powdered ingredients separately or in certain combination. As an example, a product in accordance with this invention can be made using a 60 inches wide polypropylene meltblown base web having a basis weight of 165 grams per square meter produced at a line speed of 100 feet per minute using 6 banks. Powder spray devices can be positioned next to bank Nos. 2–5 to essentially confine the powder to the middle of the product. Sodium citrate can be blown into the meltblown fiber stream at a rate of about 6.4 grams per second per bank. The resulting web can be wound up for further processing, or it can be directly saturated with liquid detergent, as described in connection with FIG. 2.

Figure 2:
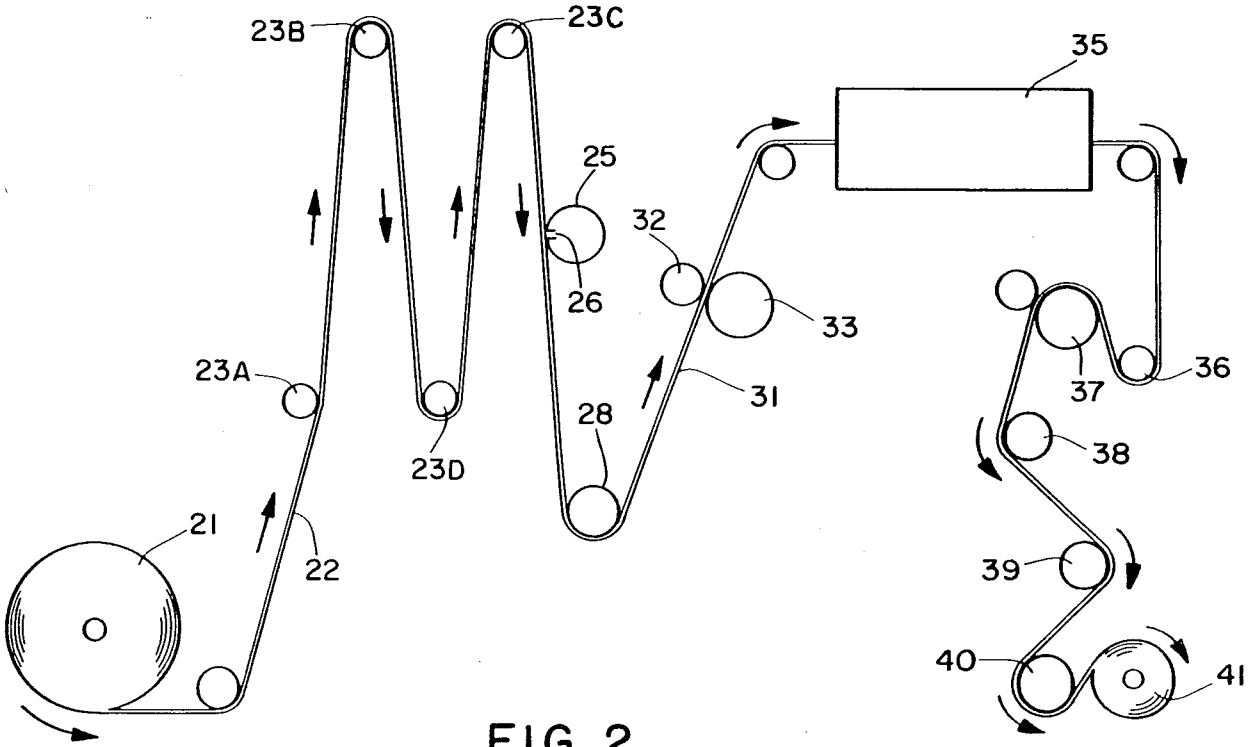
FIG. 2 is a schematic view of a method for saturating the powder-treated meltblown web with the balance of the liquid detergent ingredients.

FIG. 2, shows a supply roll 21 of the powder-treated meltblown web, which contains certain powdered detergent ingredients as described in connection with FIG. 1, to be saturated with the balance of the liquid detergent ingredients. Preferably the web has been thermally pattern-bonded to provide sufficient integrity to withstand a wash and dry cycle without disintegrating. The web 22 is passed through a series of tension control rolls 23A, 23B, 23C, and 23D and passed over a slotted bar applicator 25 which is filled with an aqueous solution containing the balance of the detergent formulation, primarily containing the active detergent solids. The solution is deposited onto the web through slot 26 to saturate the web with the solution. The rate at which the solution is applied to the web will depend upon the line speed, the detergent composition, the absorbency of the web, etc. Other means for incorporating the solution into the web are also suitable, however. The solution can be applied to either or both sides of the web.

After leaving the slotted bar applicator, the saturated web 31 passes through a controlled nip between nip rolls 32 and 33 which serves to enhance the even distribution of the solution throughout the web.

The treated web then passes through a dryer 35, preferably an air flotation dryer, which preferably removes substantially all (up to about 95 percent) of the available moisture, which includes alcohol and water. More typically the moisture removal will be on the order of about 80 percent. The product leaving the dryer contains concentrated liquid detergent having a gel-like consistency, yet the web has an acceptable feel.

After drying, the dried web passes around a tension control roll 36, a pull roll 37, a slitter roll 38, a Mount Hope roll 39, and a rewind drive roll 40. The web is thereby wound onto the rewind roll 41 for subsequent converting and packaging operations.

It will be appreciated that the foregoing discussion, given for purposes of illustration, is not to be construed as limiting the scope of this invention.

I claim:

1. A method for making a laundry detergent sheet comprising:

(a) forming a meltblown web by meltblowing a thermoplastic polymer to form fibers, which are deposited onto a travelling forming wire;

(b) interspersing powdered detergent ingredients among the meltblown fibers before the meltblown fibers are completely solidified;

(c) solidifying the meltblown fibers, whereby the powdered detergent ingredients become adhered thereto;

(d) saturating the meltblown web with the balance of the detergent ingredients; and (e) drying the saturated web to a water content of about 10 weight percent or less.

2. The method of claim 1 wherein the meltblown web is formed with a plurality of meltblowing banks and wherein the powdered detergent ingredients are interspersed among the meltblown fibers formed by the central meltblowing banks.

3. The method of claim 1 wherein the powdered liquid detergent ingredients are interspersed with the unsolidified meltblown fibers by metering the powdered ingredients into an airstream which impinges upon the meltblown fibers before they are deposited onto the forming wire.

4. The method of claim 3 wherein the impinging airstream contains fibers.

* * * * *